US009042585B2

(12) United States Patent
Chang et al.

(10) Patent No.: US 9,042,585 B2
(45) Date of Patent: May 26, 2015

(54) METHOD FOR OPTIMIZING PERFORMANCE OF A MULTI-TRANSDUCER EARPIECE AND A MULTI-TRANSDUCER EARPIECE

(75) Inventors: Thean Kuie Christopher Chang, Singapore (SG); Hui Ying Alexa Phua, Singapore (SG)

(73) Assignee: Creative Technology Ltd, Singapore (SG)

( * ) Notice: Subject to any disclaimer, the term of this patent is extended or adjusted under 35 U.S.C. 154(b) by 512 days.

(21) Appl. No.: 12/958,198

(22) Filed: Dec. 1, 2010

(65) Prior Publication Data

US 2012/0140975 A1 Jun. 7, 2012

(51) Int. Cl.

| | |
|---|---|
| ***H04R 25/00*** | (2006.01) |
| ***H04R 1/26*** | (2006.01) |
| *H04R 1/10* | (2006.01) |
| *H04R 1/28* | (2006.01) |

(52) U.S. Cl.
CPC .. *H04R 1/26* (2013.01); *H04R 1/10* (2013.01); *H04R 1/2857* (2013.01); *H04R 2420/07* (2013.01)

(58) Field of Classification Search
None
See application file for complete search history.

(56) References Cited

U.S. PATENT DOCUMENTS

| | | | | |
|---|---|---|---|---|
| 6,307,943 | B1 * | 10/2001 | Yamagishi | 381/312 |
| 7,317,806 | B2 * | 1/2008 | Harvey et al. | 381/328 |
| 2008/0240485 | A1 * | 10/2008 | Dyer et al. | 381/380 |

* cited by examiner

*Primary Examiner* — Duc Nguyen
*Assistant Examiner* — Taunya McCarty
(74) *Attorney, Agent, or Firm* — Russell Swerdon; Desmund Gean

(57) ABSTRACT

There is provided a method for optimizing performance of a multi-transducer earpiece, where the multi-transducer earpiece includes a perpendicular flange that partitions the cross sectional area of the acoustic delivery channel in a manner where mixing of signals from both the high frequency transducer and the mid/low frequency transducer is carried out in the ear canal of a user during reproduction of audio signals.

7 Claims, 5 Drawing Sheets

METHOD FOR OPTIMIZING PERFORMANCE OF A MULTI-TRANSDUCER EARPIECE AND A MULTI-TRANSDUCER EARPIECE

FIELD OF INVENTION

The present invention relates to the field of audio reproduction apparatus, primarily a method for optimizing performance of a multi-transducer earpiece and a multi-transducer earpiece.

BACKGROUND

Earpieces are commonly used to listen to all forms of audio content. The earpieces may receive the audio content via either a wired or a wireless connection to a source of audio content.

Earpieces are typically quite small and are normally located at an entrance of an ear canal of a user. As such, earpieces typically utilize miniature components employed in compact arrangements. Some earpieces are custom fit (i.e., custom molded for specific ears) while others are of a generic "one-size-fits-all" design.

Armature drivers typically use magnetically balanced shafts or armatures within a small, typically rectangular, enclosure. A disadvantage of single armature drivers is that they are incapable of providing high-fidelity performance across all frequencies. As such, armature-based earpieces typically use multiple armature drivers.

In order to obtain the best possible performance from an earpiece, the driver or drivers within the earpiece are tuned. Armature tuning is typically accomplished through the use of acoustic filters (i.e., dampers). Prior art earpieces have carried out tuning by considering phase shift for each earpiece. However, the effectiveness of the aforementioned tuning by considering phase shift is questionable in view of the small dimensions of typical earpieces.

The present invention thus aims to provide desirable audio reproduction from earpieces with multiple armature drivers without consideration of phase shift for each earpiece.

SUMMARY

In a first aspect, there is provided a multi-transducer earpiece for an audio reproduction apparatus. The earpiece includes a sound delivery member with an acoustic delivery channel, a first end of the sound delivery member being for placement of a ear bud, the ear bud being locatable at an entrance of a ear canal of a user; a sound damper for mounting the sound delivery member, the sound damper having a perpendicular flange for partitioning a cross sectional area of the acoustic delivery channel when the sound delivery member is mounted onto the sound damper; an enclosure encasing the sound damper; a high frequency transducer located within the enclosure, with a first output of the high frequency transducer being co-axial with a first sound delivery tube located in the sound damper; and a mid/low frequency transducer located within the enclosure, with a second output of the mid/low frequency transducer being co-axial with a second sound delivery tube located in the sound damper.

It is advantageous that the perpendicular flange partitions the cross sectional area of the acoustic delivery channel in a manner where mixing of signals from both the high frequency transducer and the mid/low frequency transducer is carried out in the ear canal of a user during reproduction of audio signals.

It is preferable that the acoustic delivery channel includes slots for fitment of the perpendicular flange. It is also preferable that a cross-sectional area of an ear bud end of the acoustic delivery channel is at least equal to a cross-sectional area of a sound damper end of the acoustic delivery channel such that acoustic pressure is consistent in the acoustic delivery channel. The cross sectional area of the acoustic delivery channel may be either circular or elliptical.

The perpendicular flange may be an integrated part of the sound damper and may have a rectangular cross sectional profile. The perpendicular flange advantageously partitions the cross sectional area of the acoustic delivery channel into extensions of the first sound delivery tube and the second sound delivery tube. It is also advantageous that the extensions of the first sound delivery tube and the second sound delivery tube are both more durable and take up less space compared to discrete sound delivery tubes. Preferably, both the first sound delivery tube and the second sound delivery tube enable transmission of signals from the high frequency transducer and the mid/low frequency transducer respectively to the acoustic delivery channel.

Preferably, both the high frequency transducer and the mid/low frequency transducer receive signals from a source of audio signals.

In a second aspect, there is provided a method for optimizing performance of a multi-transducer earpiece. The method includes positioning a high frequency transducer in an enclosure such that an output of the high frequency transducer is co-axial with a first sound delivery tube located in a sound damper; positioning a mid/low frequency transducer in the enclosure such that an output of the mid/low frequency transducer is co-axial with a second sound delivery tube located in the sound damper; mounting a sound delivery member onto the sound damper, the sound damper having a perpendicular flange for partitioning a cross sectional area of an acoustic delivery channel of the sound delivery member; placing a ear bud onto a first end of the sound delivery member; and locating the ear bud at an entrance of a ear canal of a user.

It is advantageous that the perpendicular flange partitions the cross sectional area of the acoustic delivery channel in a manner where mixing of signals from both the high frequency transducer and the mid/low frequency transducer is carried out in the ear canal of a user during reproduction of audio signals.

It is preferable that the enclosure encases the sound damper.

The acoustic delivery channel may include slots for fitment of the perpendicular flange. The perpendicular flange may have a rectangular cross sectional profile. It is advantageous that the perpendicular flange partitions the cross sectional area of the acoustic delivery channel into extensions of the first sound delivery tube and the second sound delivery tube. It is also advantageous that the extensions of the first sound delivery tube and the second sound delivery tube are both more durable and take up less space compared to discrete sound delivery tubes.

The cross-sectional area of an ear bud end of the acoustic delivery channel may preferably be at least equal to a cross-sectional area of a sound damper end of the acoustic delivery channel such that acoustic pressure is consistent in the acoustic delivery channel.

Preferably, both the first sound delivery tube and the second sound delivery tube enable transmission of signals from the high frequency transducer and the mid/low frequency transducer respectively to the acoustic delivery channel.

The cross sectional area of the acoustic delivery channel may be either circular or elliptical.

DESCRIPTION OF FIGURES

In order that the present invention may be fully understood and readily put into practical effect, there shall now be described by way of non-limitative example only preferred embodiments of the present invention, the description being with reference to the accompanying illustrative drawings.

DESCRIPTION OF PREFERRED EMBODIMENTS

The following description will relate to illustrative embodiments of the present invention. The graphic representations shown in the figures will be continually referred to when describing the present invention.

Figure 1:
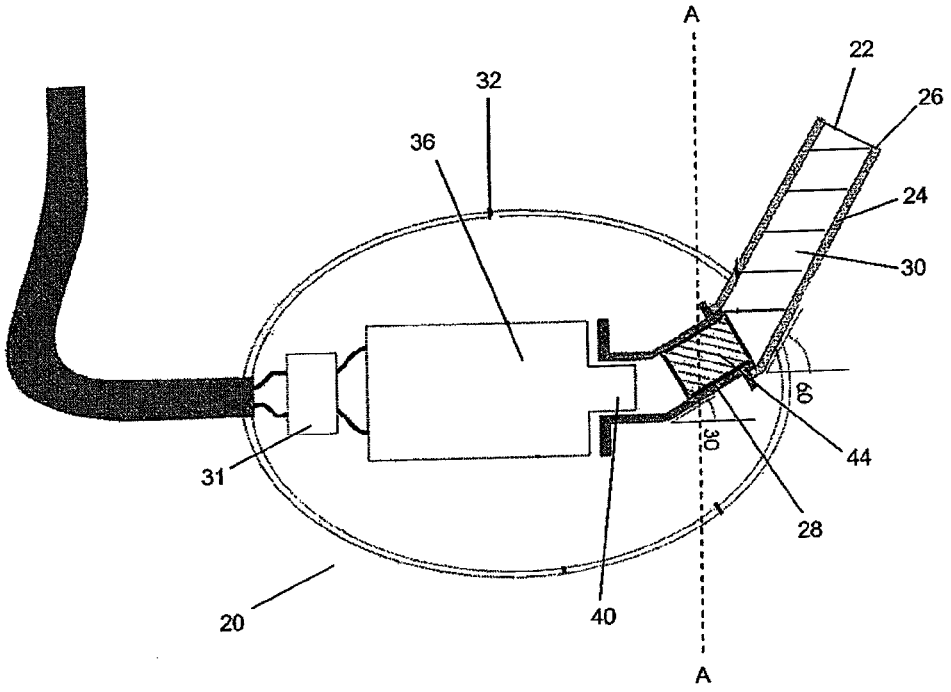
FIG. 1 shows a front view of an earpiece of the present invention.
Figure 2:
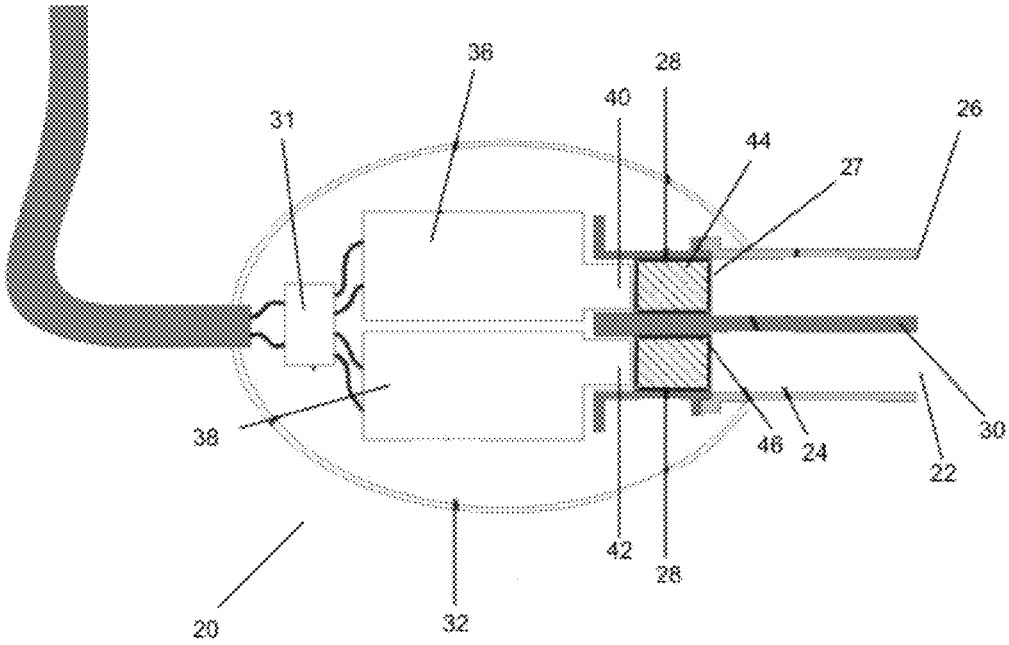
FIG. 2 shows a sectional view of the earpiece of FIG. 1 cut across an axis A-A.

There is provided a multi-transducer earpiece 20 for an audio reproduction apparatus. FIG. 1 shows a front view of the multi-transducer earpiece 20 while FIG. 2 shows a sectional view of the multi-transducer earpiece 20, whereby the sectional view is where the multi-transducer earpiece 20 is cut across an axis A-A as shown in FIG. 1.

Figure 3A:
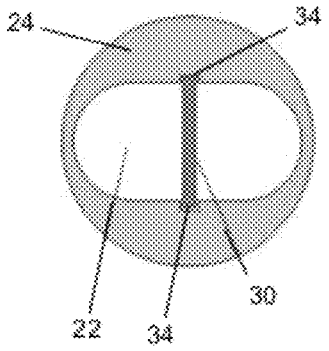
FIG. 3 shows possible cross sectional shapes of an acoustic delivery channel of a sound delivery member of the earpiece of FIG. 1.
Figure 3B:
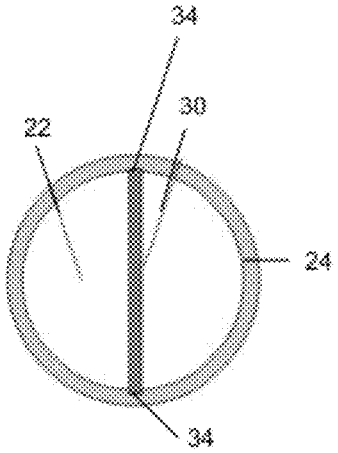

The multi-transducer earpiece 20 includes a sound delivery member 24 with an acoustic delivery channel 22. Referring to FIG. 3, there is shown possible cross sectional shapes of the acoustic delivery channel 22 of the sound delivery member 24. FIG. 3(*a*) shows the acoustic delivery channel 22 having an elliptical cross sectional area while FIG. 3(*b*) shows the acoustic delivery channel 22 having a circular cross sectional area. A first end 26 of the sound delivery member 24 is for placement of a ear bud (not shown), whereby the ear bud is locatable at an entrance of a ear canal of a user during use of the multi-transducer earpiece 20.

The multi-transducer earpiece 20 also includes a sound damper 28 for mounting the sound delivery member 24. The sound damper 28 may be integrated with a perpendicular flange 30 for partitioning the cross sectional area of the acoustic delivery channel 22 when the sound delivery member 24 is mounted onto the sound damper 28. A cross-sectional area of the first end 26 of the acoustic delivery channel 22 should be at least equal to a cross-sectional area of a sound damper end 27 of the acoustic delivery channel 22 such that acoustic pressure is consistent in the acoustic delivery channel 22. It should be noted that consistent acoustic pressure in the acoustic delivery channel 22 enables consistent audio reproduction by the multi-transducer earpiece 20.

Figure 4A:
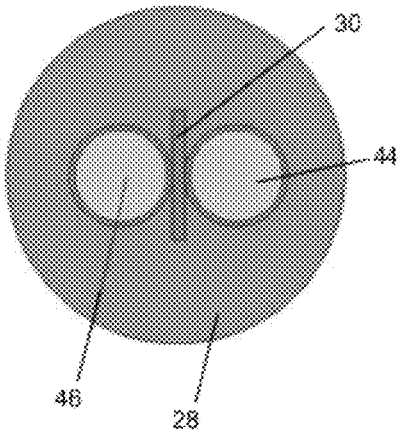
FIG. 4 shows possible cross sectional shapes of a sound damper of the earpiece of FIG. 1.
Figure 4B:
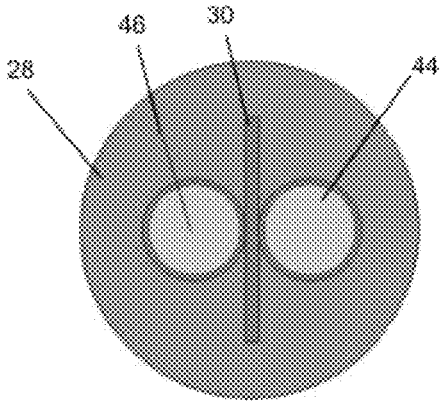
Figure 5:
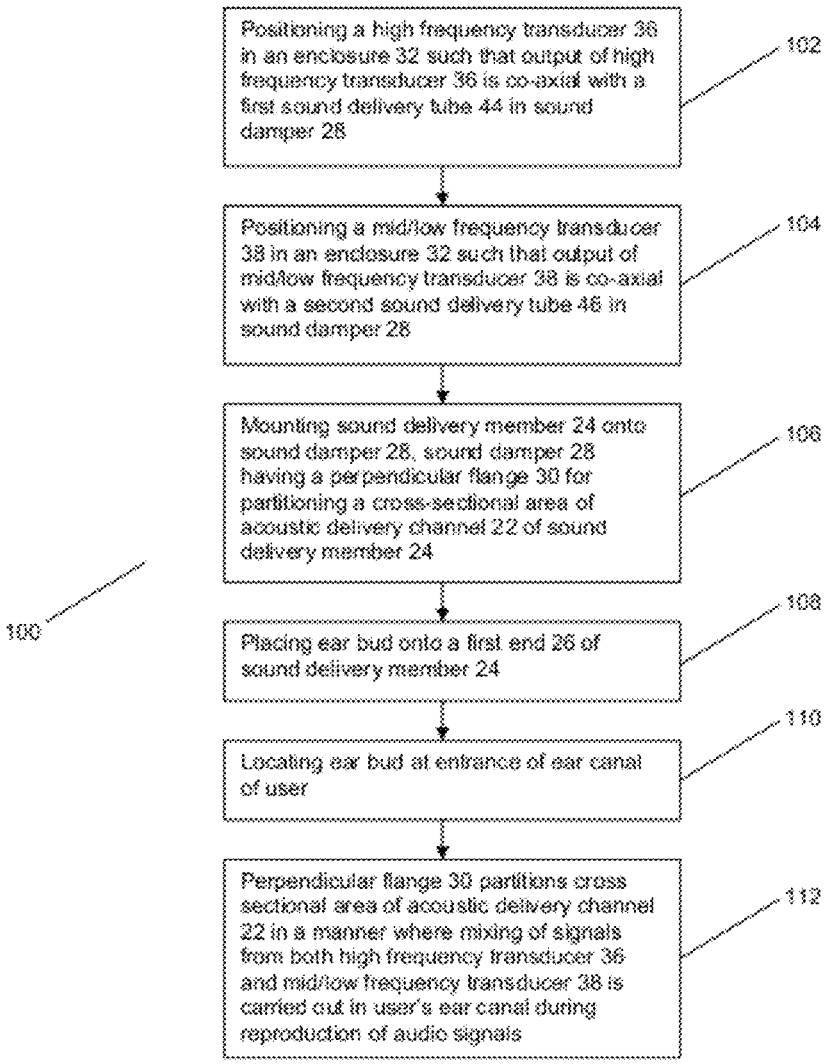
FIG. 5 shows a process flow for a method of the present invention.

The perpendicular flange 30 may have a rectangular cross sectional profile. FIG. 4 shows variations in relation to a breadth of the perpendicular flange 30 integrated with the sound damper 28. In addition, FIG. 3 shows the perpendicular flange 30 when partitioning the cross sectional area of the acoustic delivery channel 22. It should be noted that the perpendicular flange 30 partitions the cross sectional area of the acoustic delivery channel 22 into extensions of a first sound delivery tube 44 and a second sound delivery tube 46. The first sound delivery tube 44 and the second sound delivery tube 46 are located in the sound damper 28. The extensions of the first sound delivery tube 44 and the second sound delivery tube 46 defined by the perpendicular flange 30 and the acoustic delivery channel 22 are both more durable and take up less space compared to discrete sound delivery tubes. The breadth of the perpendicular flange 30 should be at least as lengthy as a diameter of each sound delivery tube 44, 46.

FIG. 3 also denotes slots 34 formed in the acoustic delivery channel 22 for fitment of the perpendicular flange 30. However, it should be noted that presence of the slots 34 merely aid in fitting the perpendicular flange 30 in the acoustic delivery channel 22 and are not mandatory features of the acoustic delivery channel 22.

There is an enclosure 32 encasing the sound damper 28. The enclosure 32 may be a portion of the multi-transducer earpiece 20 which is held by the user when locating the ear bud at the entrance of a ear canal of the user during use of the multi-transducer earpiece 20. There is a high frequency transducer 36 located within the enclosure 32. A first output 40 of the high frequency transducer 36 is co-axial with the first sound delivery tube 44 located in the sound damper 28. In addition, a mid/low frequency transducer 38 is also located within the enclosure 32, with a second output 42 of the mid/low frequency transducer 38 being co-axial with the second sound delivery tube 46 located in the sound damper 28. Both the high frequency transducer 36 and the mid/low frequency transducer 38 receive signals from a source of audio signals subsequent to passing through an electrical crossover circuit 31 incorporated within the multi-transducer earpiece 20. Both the first sound delivery tube 44 and the second sound delivery tube 46 enable transmission of signals from the high frequency transducer 36 and the mid/low frequency transducer 38 respectively to the acoustic delivery channel 22.

It is advantageous that the perpendicular flange 30 partitions the cross sectional area of the acoustic delivery channel 22 in a manner where mixing of signals from both the high frequency transducer 36 and the mid/low frequency transducer 38 is carried out in the ear canal of a user during reproduction of audio signals. In addition, ergonomic design of the multi-transducer earpiece 20 in relation to ear fitment is able to be enhanced as the cross sectional area of the acoustic delivery channel 22 of the multi-transducer earpiece 20 is able to be minimized since discrete sound delivery tubes are not employed in the multi-transducer earpiece 20. Finally, assembly of the multi-transducer earpiece 20 is also made easier since discrete sound delivery tubes are not employed in the multi-transducer earpiece 20.

There is also provided a method 100 for optimizing performance of a multi-transducer earpiece. The multi-transducer earpiece 20 as described in the preceding paragraphs will be referred to when describing the method 100.

The method 100 includes positioning a high frequency transducer 36 in an enclosure 32 such that an output of the high frequency transducer 36 is co-axial with a first sound delivery tube 44 located in a sound damper 28 (102). The method 100 also includes positioning a mid/low frequency transducer 38 in the enclosure 32 such that an output of the mid/low frequency transducer 38 is co-axial with a second sound delivery tube 46 located in the sound damper 28 (104). The enclosure 32 may be a portion of the multi-transducer earpiece 20 which is held by the user when locating the ear bud at the entrance of a ear canal of the user during use of the multi-transducer earpiece 20. The enclosure 32 should also encase the sound damper 28.

Subsequently, the method 100 includes mounting a sound delivery member 24 onto the sound damper 28, with the sound damper 28 having a perpendicular flange 30 for partitioning a cross sectional area of an acoustic delivery channel 22 of the sound delivery member 24 (106). A cross-sectional area of the first end 26 of the acoustic delivery channel 22 should be at least equal to a cross-sectional area of a sound damper end 27 of the acoustic delivery channel 22 such that acoustic pressure is consistent in the acoustic delivery channel 22. It should be noted that consistent acoustic pressure in the acoustic delivery channel 22 enables consistent audio reproduction by the multi-transducer earpiece 20.

The perpendicular flange 30 may have a rectangular cross sectional profile. FIG. 4 shows variations in relation to a breadth of the perpendicular flange 30 integrated with the sound damper 28. In addition, FIG. 3 shows the perpendicular flange 30 when partitioning the cross sectional area of the acoustic delivery channel 22. It should be noted that the perpendicular flange 30 partitions the cross sectional area of the acoustic delivery channel 22 into extensions of a first sound delivery tube 44 and a second sound delivery tube 46. The first sound delivery tube 44 and the second sound delivery tube 46 are located in the sound damper 28. The extensions of the first sound delivery tube 44 and the second sound delivery tube 46 defined by the perpendicular flange 30 and the acoustic delivery channel 22 are both more durable and take up less space compared to discrete sound delivery tubes. The breadth of the perpendicular flange 30 should be at least as lengthy as a diameter of each sound delivery tube 44, 46.

FIG. 3 also denotes slots 34 formed in the acoustic delivery channel 22 for fitment of the perpendicular flange 30. However, it should be noted that presence of the slots 34 merely aid in fitting the perpendicular flange 30 in the acoustic delivery channel 22 and are not mandatory features of the acoustic delivery channel 22.

Both the high frequency transducer 36 and the mid/low frequency transducer 38 receive signals from a source of audio signals subsequent to passing through the electrical crossover circuit 31 incorporated within the multi-transducer earpiece 20. Both the first sound delivery tube 44 and the second sound delivery tube 46 enable transmission of signals from the high frequency transducer 36 and the mid/low frequency transducer 38 respectively to the acoustic delivery channel 22. Referring to FIG. 3, there is shown possible cross sectional shapes of the acoustic delivery channel 22 of the sound delivery member 24. FIG. 3(*a*) shows the acoustic delivery channel 22 having an elliptical cross sectional area while FIG. 3(*b*) shows the acoustic delivery channel 22 having a circular cross sectional area.

A ear bud is then placed onto a first end 26 of the sound delivery member 24 (108). The ear bud is then located at an entrance of a ear canal of a user (110).

Finally, in the method 100, the perpendicular flange 30 partitions the cross sectional area of the acoustic delivery channel 22 in a manner where mixing of signals from both the high frequency transducer 36 and the mid/low frequency transducer 38 is carried out in the ear canal of a user during reproduction of audio signals (112).

It is advantageous that the method 100 also enables ergonomic design of the multi-transducer earpiece 20 in relation to ear fitment to be enhanced as the cross sectional area of the acoustic delivery channel 22 of the multi-transducer earpiece 20 is able to be minimized since discrete sound delivery tubes are not employed in the multi-transducer earpiece 20. Finally, assembly of the multi-transducer earpiece 20 is also made easier by the method 100 since discrete sound delivery tubes are not employed in the multi-transducer earpiece 20.

Whilst there has been described in the foregoing description preferred embodiments of the present invention, it will be understood by those skilled in the technology concerned that many variations or modifications in details of design or construction may be made without departing from the present invention.

The invention claimed is:

1. A multi-transducer earpiece for an audio reproduction apparatus, the earpiece including:

a sound delivery member with an acoustic delivery channel having a cross section area, a first end of the sound delivery member being for placement of an ear bud, the ear bud being locatable at an entrance of an ear canal of a user;

a sound damper for mounting the sound delivery member;

a first single sound delivery tube and a second single sound delivery tube located in the sound damper, a perpendicular flange which is integral to the sound damper, the flange for partitioning the cross sectional area of the acoustic delivery channel into an extension of the first single sound delivery tube and an extension of the second single sound delivery tube when the sound delivery member is mounted onto the sound damper, the extension of the first single sound delivery tube being separated from the extension of the second single sound delivery tube by only the flange, and the breadth of the perpendicular flange is at least as lengthy as the diameter of each of the first and second sound delivery tube;

a high frequency transducer having a first output positionable to be co-axial with the first single sound delivery tube; and a mid or low frequency transducer having a second output positionable to be co-axial with the second single sound delivery tube;

wherein mixing of signals from the first and second outputs is carried out in the ear canal of a user during reproduction of audio signals.

2. The multi-transducer earpiece of claim 1, wherein the acoustic delivery channel includes slots for fitment of the perpendicular flange.

3. The multi-transducer earpiece of claim 1, wherein a cross-sectional area of an ear bud end of the acoustic delivery channel is at least equal to a cross-sectional area of a sound damper end of the acoustic delivery channel such that acoustic pressure is consistent in the acoustic delivery channel.

4. The multi-transducer earpiece of claim 1, wherein the perpendicular flange has a rectangular cross sectional profile.

5. The multi-transducer earpiece of claim 1, wherein both the high frequency transducer and the mid or low frequency transducer receive signals from a source of audio signals subsequent to passing through an electrical crossover circuit incorporated within the multi-transducer earpiece.

6. The multi-transducer earpiece of claim 1, wherein both the first sound delivery tube and the second sound delivery tube enable transmission of signals from the high frequency transducer and the mid or low frequency transducer respectively to the acoustic delivery channel.

7. The multi-transducer earpiece of claim 1, wherein the cross sectional area of the acoustic delivery channel is either circular or elliptical.

* * * * *